US012038021B2

(12) United States Patent
Henn et al.

(10) Patent No.: US 12,038,021 B2
(45) Date of Patent: Jul. 16, 2024

(54) AUTOMOTIVE FLUID PUMP ARRANGEMENT WITH A MOUNTING DEVICE FOR AN AUTOMOTIVE FLUID PUMP ARRANGEMENT

(71) Applicant: PIERBURG PUMP TECHNOLOGY GMBH, Neuss (DE)

(72) Inventors: Steffen Henn, Neuss (DE); Rocco Kundt, Neuss (DE); Rene Patzner, Neuss (DE); Ronald Rathke, Neuss (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 0 days.

(21) Appl. No.: 18/038,028

(22) PCT Filed: Nov. 23, 2020

(86) PCT No.: PCT/EP2020/083072

§ 371 (c)(1),
(2) Date: May 22, 2023

(87) PCT Pub. No.: WO2022/106038

PCT Pub. Date: May 27, 2022

(65) Prior Publication Data

US 2024/0003363 A1 Jan. 4, 2024

(51) Int. Cl.

| | |
|---|---|
| ***F04D 29/60*** | (2006.01) |
| ***F04D 1/00*** | (2006.01) |
| ***F04D 29/66*** | (2006.01) |

(52) U.S. Cl.

CPC ..... *F04D 29/605* (2013.01); *F04D 1/00* (2013.01); *F04D 29/60* (2013.01); *F04D 29/669* (2013.01)

(58) Field of Classification Search

CPC ..... F04D 1/00; F04D 29/60; F04D 29/605; F04D 29/669

See application file for complete search history.

(56) References Cited

U.S. PATENT DOCUMENTS

2005/0058556 A1* 3/2005 Cremer ..... B60K 15/077 417/363

2017/0343153 A1 11/2017 Yilmaz et al.

(Continued)

FOREIGN PATENT DOCUMENTS

DE 10 2016 209 204 A1 11/2017

WO WO 2020/083495 A1 4/2020

(Continued)

*Primary Examiner* — Audrey B. Walter

(74) *Attorney, Agent, or Firm* — Norman B. Thot

(57) ABSTRACT

An automotive fluid pump arrangement includes a pump unit having an axial pump unit stop surface, and a mounting device which supports and mounts the pump unit. The mounting device has a support part having a ring-shape. The support part radially encloses, supports, and provides a vibration-decoupling of the pump unit. The support part has an axial support part stop surface which corresponds to and which cooperates with the axial pump unit stop surface so as to axially stop the pump unit in an axial mounting direction, a mounting part which attaches the mounting device to a corresponding motor vehicle mounting structure, and a tensioned friction enhancing longitudinal lip ring which is arranged to surround the pump unit utricularly so as to frictionally lock the pump unit in an axial dismounting direction.

18 Claims, 4 Drawing Sheets

(56) References Cited

U.S. PATENT DOCUMENTS

| | | | |
|---|---|---|---|
| 2021/0388852 | A1 | 12/2021 | Findeisen et al. |
| 2021/0388853 | A1 | 12/2021 | Findeisen et al. |

FOREIGN PATENT DOCUMENTS

| | | | | |
|---|---|---|---|---|
| WO | WO 2020/083496 | A1 | 4/2020 | |
| WO | WO-2020083495 | A1 * | 4/2020 | ..... F04D 29/60 |

* cited by examiner

AUTOMOTIVE FLUID PUMP ARRANGEMENT WITH A MOUNTING DEVICE FOR AN AUTOMOTIVE FLUID PUMP ARRANGEMENT

CROSS REFERENCE TO PRIOR APPLICATIONS

This application is a U.S. National Phase application under 35 U.S.C. § 371 of International Application No. PCT/EP2020/083072, filed on Nov. 23, 2020. The International Application was published in English on May 27, 2022 as WO 2022/106038 A1 under PCT Article 21(2).

FIELD

The present invention is directed to an automotive fluid pump arrangement, and in particular to an automotive fluid pump arrangement with a vibration decoupling mounting device for mounting an automotive fluid pump unit onto a motor vehicle mounting structure.

BACKGROUND

Such a pump arrangement comprises a pump unit, for example, an electric pump unit, for circulating a fluid within a motor vehicle fluid circuit for water circulation. The pump arrangement further comprises a mounting arrangement for mounting the pumping unit to a motor vehicle frame or to an internal combustion engine. The mounting arrangement is provided with a vibration-decoupling body which is attachable to the motor vehicle frame and which supports the pump unit. The vibration-decoupling body is made of a relatively flexible material so that relevant vibrations of the pump unit are not transferred to the motor vehicle frame or to the internal combustion engine and vice versa, resulting in relatively low noise emission levels. The decoupling body is typically ring-shaped and radially encloses as well as supports the pump unit.

Such a pump arrangement is, for example, described in DE 10 2016 209 204 A1. The ring opening of the vibration decoupling body is here press fitted to a corresponding peripheral surface of a pump unit housing so that the pumping unit is supported by the decoupling body in a force-locked manner. Since the decoupling body must be relatively flexible to provide an efficient vibrational decoupling, the force-locked connection can only support relatively small axial forces. The pump unit housing is therefore provided with radially protruding support protrusions which are in axial contact with the decoupling body to provide an additional form-locked axial support of the pump unit at the decoupling body. The support protrusions are arranged on both axial sides of the decoupling body to provide a support in both axial directions. The decoupling body must, however, be mounted to the pump unit during the assembly of the pump unit housing and cannot in particular be mounted to a completely assembled pumping unit. The decoupling body mounting step must therefore be integrated into the pump unit assembly process which results in a complex assembly of the pump arrangement.

WO 2020/083495 A1 describes a mounting arrangement with a flexible decoupling body to mount a completely assembled pump unit to a motor vehicle mounting structure. The pump unit is inserted into the decoupling body and is axially fixed by a form-locked connection using an axial stop surface at the decoupling body and a corresponding stop surface at the pump unit. This form-locked connection secures the pump unit in the first axial mounting direction. The pump unit is additionally fixed by a separate retainer clip in the second axial dismounting direction.

All of these fixation methods described in the prior art require additional fixation elements and/or a complex mounting process to attach the pump unit to the decoupling body.

SUMMARY

An aspect of the present invention is to provide an automotive fluid pump arrangement which provides a reliable and cost-efficient vibration decoupled mounting of the pump unit to a motor vehicle frame which can also be assembled in a simple manner.

In an embodiment, the present invention provides an automotive fluid pump arrangement which includes a pump unit comprising an axial pump unit stop surface, and a mounting device which is configured to support and to mount the pump unit. The mounting device comprises a support part having a ring-shape. The support part is configured to radially enclose, to support, and to provide a vibration-decoupling of the pump unit. The support part comprises an axial support part stop surface which is configured to correspond to and to cooperate with the axial pump unit stop surface so as to axially stop the pump unit in an axial mounting direction, a mounting part which is configured to attach the mounting device to a corresponding motor vehicle mounting structure, and a tensioned friction enhancing longitudinal lip ring which is arranged to surround the pump unit utricularly so as to frictionally lock the pump unit in an axial dismounting direction.

BRIEF DESCRIPTION OF THE DRAWINGS

The present invention is described in greater detail below on the basis of embodiments and of the drawings in which.

DETAILED DESCRIPTION

Figure 1:
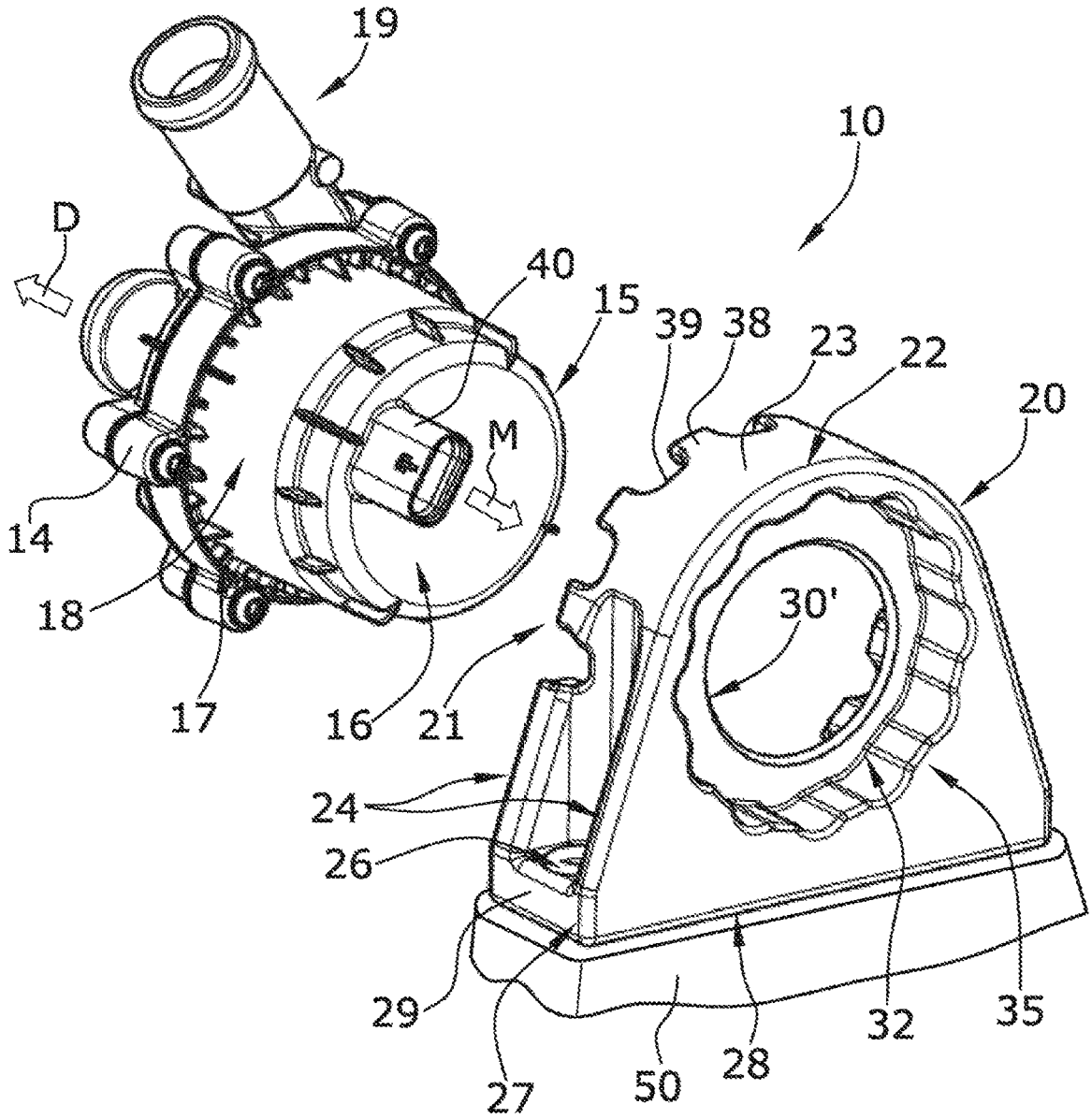
FIG. 1 shows a perspective view of an automotive fluid pump arrangement with a pump unit and a mounting device in a disassembled state.

The motor vehicle pump arrangement according to the present invention is provided with a pump unit for circulating a working fluid in a motor vehicle fluid circuit. The pump unit can, for example, be electrically driven by an electric motor and is not mechanically driven by an internal combustion engine. The pump unit can in particular be an electric water pump for circulating water within a motor vehicle heating or cooling circuit.

The automotive fluid pump arrangement according to the present invention is also provided with a mounting device for mounting the pump unit to a motor vehicle frame. The mounting device comprises a ring-shaped vibration decoupling support part which extends substantially in a transversal pumping unit plane. The support part radially encloses and supports the pumping unit. The support part is provided with a transversal ring opening, which corresponds with the shape of a pumping unit mounting section so that the pumping unit is radially supported by the support part substantially along the entire circumference.

The support part can, for example, radially enclose the electric motor of the electric pump unit so that the center of mass of the pumping unit is located substantially within the support part. The mounting device further comprises a mounting part for attaching the mounting device to a motor vehicle mounting structure. The pump unit is supported at the motor vehicle frame only via the mounting device and is, in particular, not in direct contact with the motor vehicle frame. The support part can, for example, be made of a relatively soft and elastic material, for example, of rubber, silicone, SEBS, EPDM or any other elastomer, so that the vibration decoupling support part can compensate vibrations of the motor vehicle frame.

The support part is provided with an axial stop surface which is oriented substantially perpendicular to a pump unit rotation axis. The pump unit is provided with a corresponding stop surface which cooperates with the support body's axial stop surface to secure the pump in a first axial pump unit inserting direction, namely, in the mounting direction. The support part is also provided with a tensioned friction-enhancing longitudinal lip ring which acts in a pressure sleeve-type manner. The elastic lip ring surrounds the pump unit utricularly and exerts a normal force at an outer pump unit mounting section so that a friction force is applied between the lip ring and the pump unit which frictionally locks the pump unit in an axial dismounting direction.

Before the pump unit is assembled with the mounting device, the inside perimeter of the lip ring can, for example, be at least 5% smaller than the outside perimeter of the pump unit mounting section. In this pre-assembled state, the lip ring extends substantially radially inwards from the opening of the support part and can, for example, be slightly conical. The conical lip ring tapers in mounting direction so that the pump unit is guided during the insertion process. Due to the smaller inside diameter of the lip ring compared to the outside diameter of the pump unit mounting section, the lip ring flips over in mounting direction during the assembly of the pump unit with the support part and adapts gapless to the pump unit mounting section. This deformation tensions the lip ring so that a relatively high normal force acting at the mounting section is provided by the lip ring, which is substantially higher than the normal force of a conventional press-fitted connection. The resulting friction force is sufficient to axially secure the pump unit within the support part against any usual axial displacement force. The support part thereby secures the pump unit in both axial directions, namely, in the mounting direction and in the dismounting direction, without any additional fixing means, such as clips or screws. In the assembled state, the lip ring is accordingly substantially completely axially oriented and contacts the outer surface of the pump unit as well as at the inner surface of the ring opening.

Due to the higher friction forces between the tensioned lip ring and the pump unit mounting section compared to the friction forces between the lip ring and the inner surface of the ring opening, the lip ring does not slip at the outer surface of the pump unit mounting section if the pump unit is displaced in the dismounting direction, but instead slips at the inner surface of the ring opening. The utricular lip ring stays in contact with the pump unit and is thereby folded in a bellow-type manner so that the lip ring jams inside the ring opening of the support body and blocks a further displacement of the pump unit. The jamming of the friction-locked lip ring therefore provides a kind of form-locked connection in the dismounting direction without the necessity of any undercuts at the pump unit housing.

In an embodiment of the automotive fluid pump arrangement according to the present invention, the lip ring can, for example, be an integral part of the elastomeric support part. The lip ring can, for example, be integrally formed onto the elastomeric support body at the inner surface of the ring opening. The pump unit is thereby radially supported and axially fixed both in the mounting direction and in the dismounting direction by one single part so that no additional fixation elements are needed for connecting the lip ring to the support part. This integral design results in relatively low production costs because no additional assembly step is required for axially securing the pump unit with a clip or with screws. The integral lip ring provides a relatively compact design of the support part, and thereby a compact design of the mounting device, which is particularly favorable for an automotive application of the pump arrangement.

In an embodiment of the present invention, the ring-shaped supporting body and the corresponding mounting section of the pump unit can, for example, be circular. The circular shape generally allows a free adaption of the orientation of the tangentially oriented pump outlet, even after the pump unit has been mounted to the motor vehicle. The mounting device and thus the pump unit can thus be mounted to different motor vehicles at different mounting positions so that a kind of all-purpose mounting device is provided. The circular shape also simplifies the mounting process of the pump unit with the support part. Due to the friction forces between the lip ring and the pump unit, the rotation of the pump unit during the mounting process simplifies the insertion of the pump unit into the ring shaped support part.

In an embodiment of the present invention, the axial supporting body stop surface can, for example, be provided with a castellated structure comprising several axially extending merlons. The merlons of the castellated structure can, for example, be disposed along the circumference of the support part in an equiangular arrangement so as to define several pump receptacles between them. The stop surface of the pump unit is provided with a corresponding castellated structure which is, for example, defined by the screw sockets of the pump unit housing. In the mounted state of the pump arrangement, the screw sockets of the pump unit housing engage the pump receptacles so that the pump unit cannot rotate within the support part. The pumping unit is therefore provided with a defined and stable rotational orientation with respect to the support part and, as a result, with respect to the motor vehicle frame. The castellated structure thereby defines a simple anti-rotation protection of the pump unit.

In an embodiment of the present invention, the electrical plug socket of the electrical pump unit can, for example, extend axially from the axial front-end surface of the pump unit. The axial front-end surface is defined at the end of the pumping unit axially opposite to the volute of the pump housing. The pump is inserted into the ring opening of the support part with the front-end first so that the axial front-end surface is oriented in the mounting direction. The electrical plug socket is arranged so that it does not radially exceed the pump unit mounting section, and can, for example, be arranged with a radial distance to the pump unit mounting section so that the lip ring cannot be damaged by the plug socket during the assembly of the pump unit with the support part. The lip ring generally provides enough friction force to the pump unit to avoid a displacement of the pump unit during the axial plugging of the electrical plug to the plug socket.

In an embodiment of the present invention, the diameter of the circular lip ring can, for example, be at least 5% smaller than the diameter of the pump unit mounting section, before the pump unit is assembled with the mounting device. The resulting tensioning of the circular lip ring resulting from the radial expansion provides a homogenous normal force distribution along the complete circumference of the circular pump unit mounting section which results in a reliable axial fixation of the pump unit. The useful jamming of the lip ring caused by an axial displacement of the pump unit in dismounting direction is also more effective with a circular lip ring.

In an embodiment of the present invention, the mounting part for attaching the mounting device to the motor vehicle mounting structure can, for example, be an integral part of the ring-shaped support part. The complete mounting device is thereby defined by one single low-cost piece which reduces manufacturing effort and the assembly effort compared to a multi piece mounting device. The mounting device can, for example, be attached to the motor vehicle mounting structure by a screw joint using integrally formed screw holes within the mounting part so that no additional machining is required for manufacturing the screw holes of the mounting device. No additional assembly step is required to connect the mounting part with the support part. The integral design provides a very compact and simple mounting device with a reliable and sufficient fixation of the pump unit in combination with an efficient vibration-decoupling of the pump unit from the motor vehicle mounting structure.

An embodiment of the present invention is described in greater detail below under reference to the enclosed drawings.

FIGS. 1 to 4 show an embodiment of an automotive fluid pump arrangement 10 according to the present invention. The automotive fluid pump arrangement 10 comprises an electric water circulation pump unit 15 and a mounting device 20 for attaching the pump unit 15 to a motor vehicle mounting structure 50. The mounting device 20 comprises a circular ring-shaped vibration-decoupling support part 22 with a circular support part ring opening 35, shown in FIGS. 1 and 3.

Figure 2:
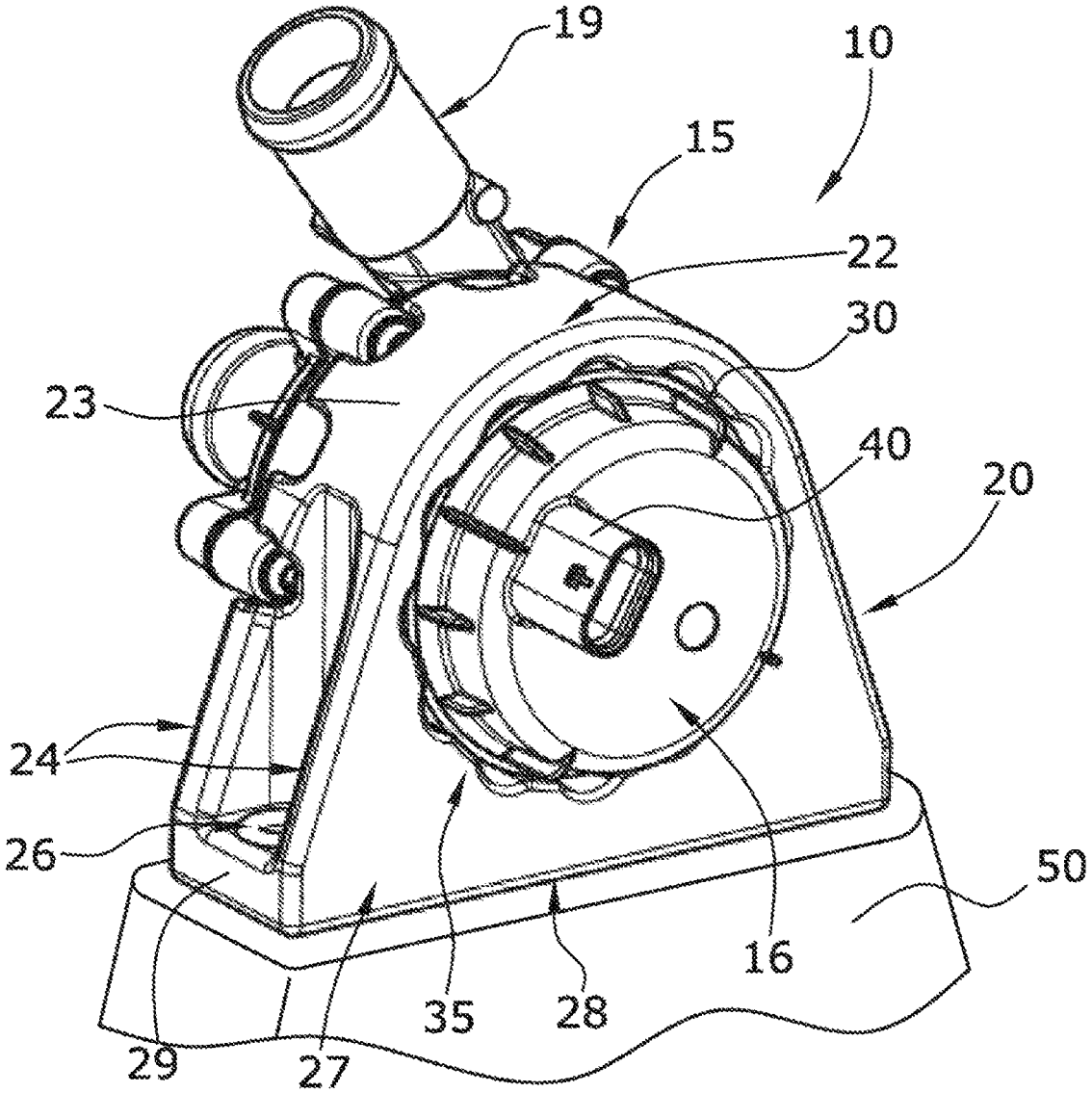
FIG. 2 shows a perspective view of the automotive fluid pump arrangement of FIG. 1 in an assembled state.
Figure 4:
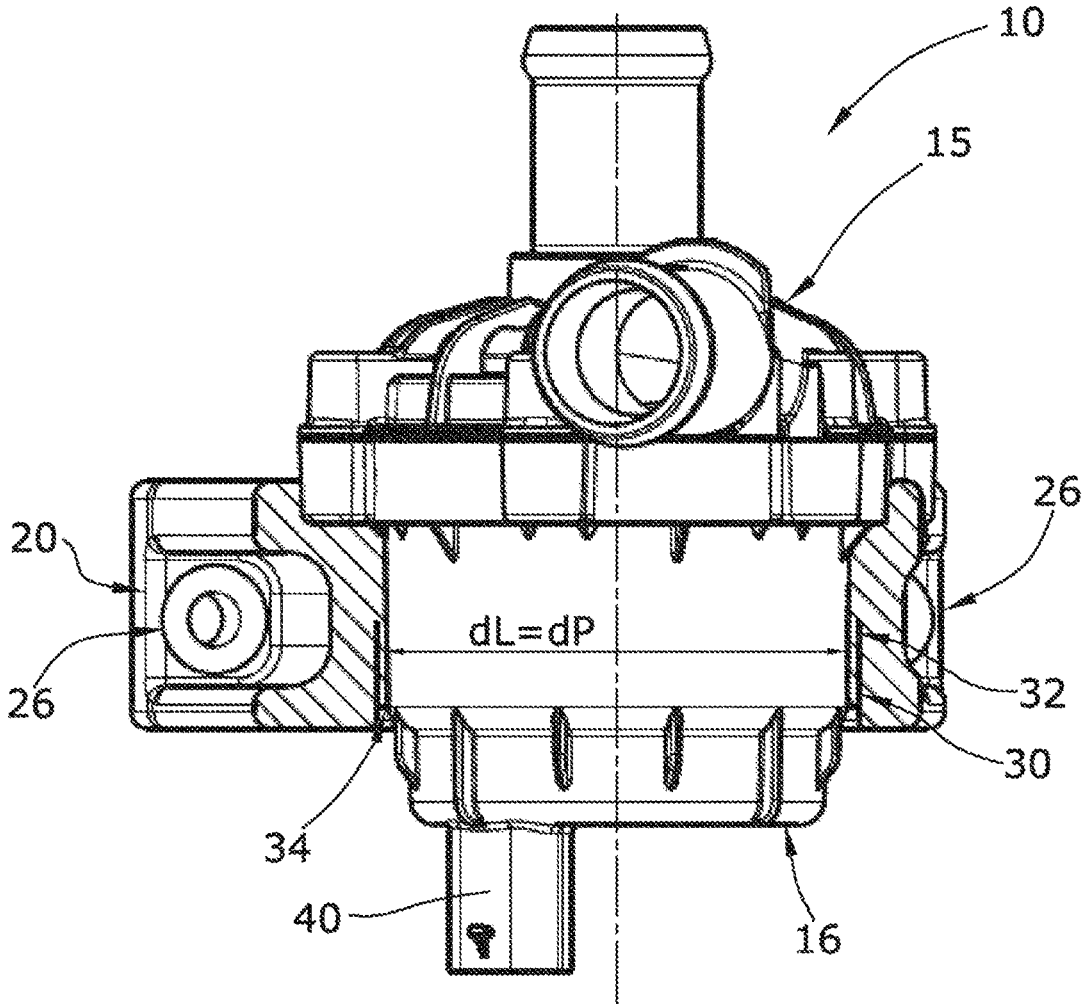
FIG. 4 shows a cross-sectional top view of the automotive fluid pump arrangement of FIG. 1 in an assembled state.

The pump unit 15 comprises a cylindrical pump unit mounting section 18 which is inserted into the support part ring opening 35 of the support part 22 for axially and radially fixing the pump unit 15. The cylindrical support part body 23 radially encloses the inserted pump unit mounting section 18 and thereby radially supports the pump unit 15, as shown in FIGS. 2 and 4.

The support part 22 is made of an elastomer to provide a vibration decoupling of the pump unit 15 from the motor vehicle mounting structure 50. The mounting device 20 further comprises a mounting part 27 which is an integral part of the support part 22. The mounting part 27 is provided with a flat rectangular mounting surface 28 which is arranged perpendicular to the pump unit center line and which contacts the motor vehicle mounting structure 50, as shown in FIGS. 1 and 2. The mounting part 27 is also provided with two screw holes 26 for attaching the mounting device 20 to the motor vehicle mounting structure 50 via a screw joint. For reinforcing the mounting device, the transition zone between the support part 22 and the mounting part 27 is provided with reinforcement ribs 24 which extend laterally in a transversal pump unit plane, the reinforcement ribs 24 being tangentially formed onto to the cylindrical support part 22 and being connected to the connection flange 29 of the mounting part 27 at both sides of the screw holes 26.

Figure 3:
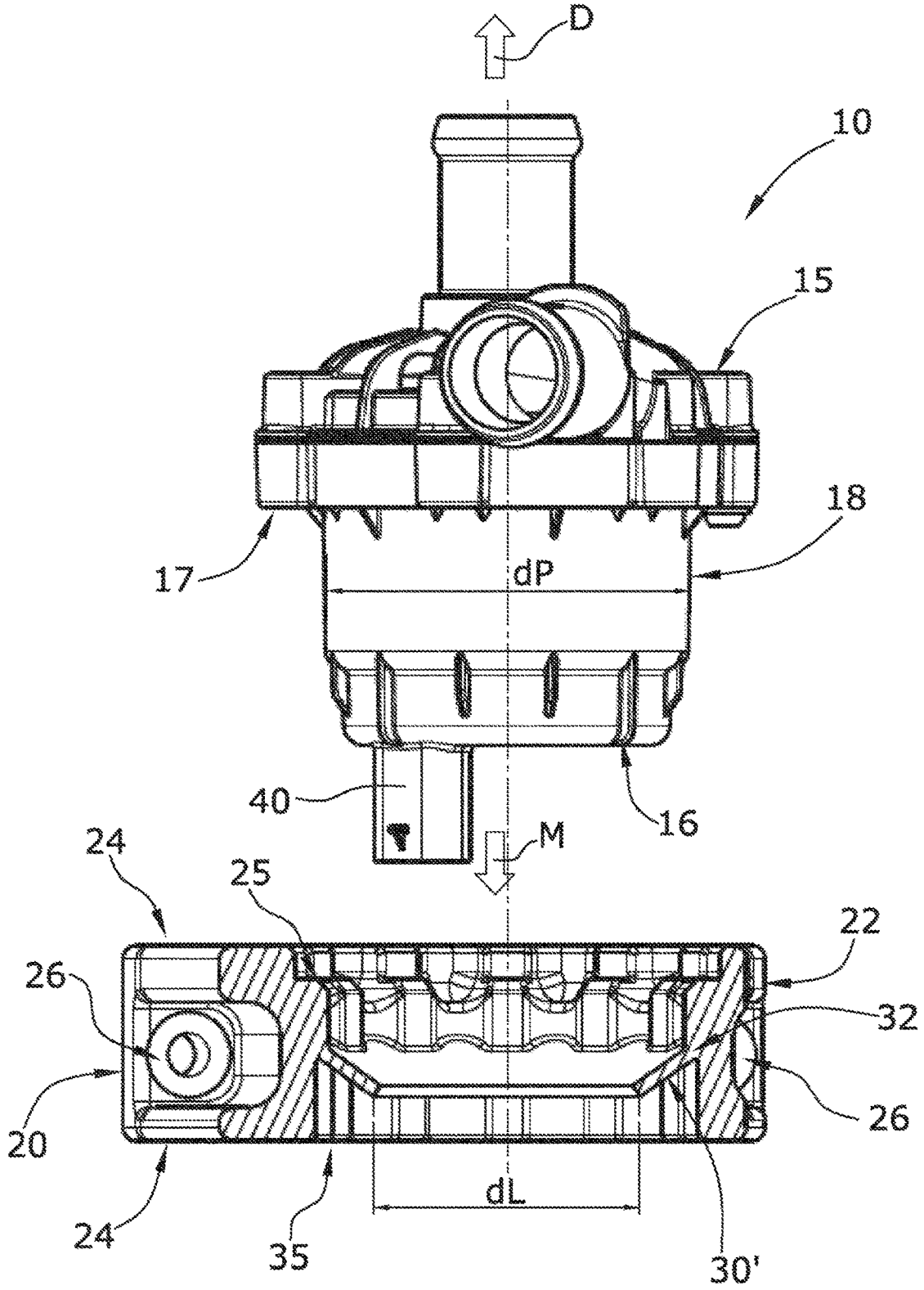
FIG. 3 shows a cross-sectional top view of the automotive fluid pump arrangement of FIG. 1 in a disassembled state.

FIGS. 1 and 3 show the automotive fluid pump arrangement 10 in a disassembled state where the inner side of the support part ring opening 35 is provided with a slightly conical and substantially radially inwards extending circular lip ring 30', which is integrally connected with the support part 22. The lip ring 30' extends radially inwards from the radial inside of the support part 22 and extends axially in mounting direction M of the pump unit, so that the lip ring 30' tapers in mounting direction M referring to its connection zone 32 with the support part 22. The inside diameter dL of the lip ring 30' is 10% smaller than the outer diameter dP of the pump unit mounting section 18, as shown in FIG. 3.

An axial front-end surface 16 defines the axial end of the pump opposite to the pump volute or the tangentially oriented fluid outlet 19. When the pump unit 15 is inserted in the mounting direction M with the axial front-end surface 16 first, the lip ring 30' is flipped over in mounting direction M and changes from a substantially radial orientation to a pure axial and longitudinal orientation. Due to the conical shape of the lip ring 30' and the tapering in the mounting direction, the pump unit mounting section 18 is guided into the support part ring opening 35 and the lip ring 30' deforms into an utricular pressure sleeve, which adapts gapless to the outer shell surface of the pump unit mounting section 18. As a result of the radial expansion of the inside diameter dL to the outer diameter dP of the pump unit mounting section 18, as shown in FIG. 4, the utricular lip ring 30 extends axially in the mounting direction M and is tensioned.

Due to the tensioning of the lip ring 30, the free end 34 of the lip ring 30 provides a radially inwards oriented and relatively high normal force to the pump unit mounting section 18 compared to a conventional pure press fitted connection. The longitudinal extension of the lip ring 30 in the axial mounting direction M combined with the relatively high friction forces between the lip ring 30 and the pump unit 15 provides a blocking effect which additionally secures the pump unit 15 in the dismounting direction D. If the pump unit 15 is displaced in the dismounting direction D, the lip ring 30 deforms in a bellow-type manner and jams between the support part 22 and the pump unit mounting section 18 so that the displacement of the pump unit 15 in the dismounting direction D is effectively blocked.

The support part 22 is provided with an axial support part stop surface 25 at the axial end of the support part 22 which is orientated in the dismounting direction D. The axial support part stop surface 25 cooperates with a corresponding pump unit axial stop surface 17 at the pump unit 15. This pump unit axial stop surface 17 is oriented opposite to the axial support part stop surface 25, namely, in the mounting direction M, so that the pump unit 15 is axially stopped by a form fitted connection, thereby securing the pump unit 15 axially in the mounting direction M, as shown in FIG. 4.

The axial support part stop surface 25 of the support part 22 is provided with a castellated structure 21 which comprises several arc-shaped merlons 38 extending axially in the dismounting direction D and which are equiangularly arranged over the circumference of the support part body 23, as shown in FIG. 1. The merlons 38 are concentrically arranged to the support part ring opening 35 and define a first member of a rotation-blocking structure of the substantially cylindrical pump unit 15. The castellated structure 21 defines several axial receptacles 39 between the merlons 38 for accommodating the cylindrical and axially oriented screw sockets 14 which are equiangularly arranged over the circumference of the pump unit 15 and radially exceed the pump unit mounting surface 18. The corresponding castellated structure 21 of the support part 22 locks the screw sockets 14 and thereby prevents the pump unit 15 from rotating within the support part ring opening 35, as shown in FIG. 2.

The pump unit 15 is provided with an electrical plug socket 40 which extends axially from the axial front-end surface 16 of the pump unit 15 in the mounting direction M. The electrical plug socket 40 is radially offset referring to the centerline of the pump unit 15, but is also offset from the outer edge of the axial front-end surface 16 so that the plug socket cannot damage the radially inwards extending lip ring 30' during the insertion of the pump unit 15 into the support part 22, as shown, for example, in FIG. 1.

The electrical plug (not shown) is plugged in the axial dismounting direction D. The friction enhancing lip ring 30 provides a sufficient axial fixation of the pump unit 15 in the dismounting direction D resulting from the relatively high friction force between the lip ring 30 and the pump unit mounting section 18 and from the jamming of the lip ring 30 caused by a slight displacement of the pump unit 15 in axial direction so that the axial plugging does not relevantly displace the pump unit 15.

The present invention is not limited to embodiments described herein; reference should be had to the appended claims.

LIST OF REFERENCE CHARACTERS

10 Automotive fluid pump arrangement
14 Screw sockets
15 Electric water circulation pump unit/Pump unit
16 Axial front-end surface
17 Pump unit axial stop surface
18 Pump unit mounting section
19 Fluid outlet
20 Mounting device
21 Castellated structure
22 Support part
23 Support part body
24 Reinforcement ribs
25 Axial support part stop surface
26 Screw holes
27 Mounting part
28 Mounting surface
29 Connection flange
30 Lip ring
30' Lip ring
32 Connection zone
34 Free end (of lip ring 30)
35 Support part ring opening
38 Merlon
39 Axial receptacle
40 Electrical plug socket
50 Motor vehicle mounting structure
D Dismounting direction
dL Inside diameter (of lip ring 30')
dP Outside diameter (of pump unit mounting section 18)
M Mounting direction

What is claimed is:

1. An automotive fluid pump arrangement comprising:
a pump unit comprising an axial pump unit stop surface; and
a mounting device which is configured to support and to mount the pump unit, the mounting device comprising
a support part having a ring-shape, the support part being configured to radially enclose, to support, and to provide a vibration-decoupling of the pump unit, the support part comprising,
an axial support part stop surface which is configured to correspond to and to cooperate with the axial pump unit stop surface so as to axially stop the pump unit in an axial mounting direction,
a mounting part which is configured to attach the mounting device to a corresponding motor vehicle mounting structure, and
a tensioned friction enhancing longitudinal lip ring which is arranged to gaplessly surround the pump unit utricularly so as to frictionally lock the pump unit in an axial dismounting direction,
wherein,
the tensioned friction enhancing longitudinal lip ring has an inside perimeter,
the pump unit further comprises a pump unit mounting section which has an outside perimeter, and
prior to an assembly of the pump unit with the mounting device, the inside perimeter of the tensioned friction enhancing longitudinal lip ring is at least 5% smaller than the outside perimeter of the pump unit mounting section.

2. The automotive fluid pump arrangement as recited in claim 1, wherein the tensioned friction enhancing longitudinal lip ring is conical prior to an assembly of the pump unit with the mounting device.

3. The automotive fluid pump arrangement as recited in claim 1, wherein the tensioned friction enhancing longitudinal lip ring is provided as an integral part of the support part.

4. The automotive fluid pump arrangement as recited in claim 1, wherein,
the tensioned friction enhancing longitudinal lip ring comprises a connection zone, and
the tensioned friction enhancing longitudinal lip ring, as seen from the connection zone with the support part, extends axially in the axial mounting direction of the pump unit.

5. The automotive fluid pump arrangement as recited in claim 1, wherein,
the pump unit further comprises an axial front-end surface and an electrical plug socket, and
the electrical plug socket is arranged to extend axially from the axial front-end surface of the pump unit.

6. The automotive fluid pump arrangement as recited in claim 1, wherein the mounting part is an integral part of the support part.

7. The automotive fluid pump arrangement as recited in claim 1, wherein the support part and the pump unit mounting section of the pump unit corresponding thereto are both circular.

8. The automotive fluid pump arrangement as recited in claim 7, wherein,
the pump unit further comprises a tangential pump outlet, and
the axial support part stop surface and the axial pump unit stop surface are each correspondingly castellated so as to provide a form-fitted connection for an anti-rotation protection of the pump unit.

9. The automotive fluid pump arrangement as recited in claim 7, wherein,
the tensioned friction enhancing longitudinal lip ring has a diameter,
the pump unit mounting section has a dimeter, and the diameter of the tensioned friction enhancing longitudinal lip ring is at least 5% smaller than the diameter of the pump unit mounting section before the pump unit is assembled with the mounting device.

10. An automotive fluid pump arrangement comprising:

a pump unit comprising an axial pump unit stop surface; and a mounting device which is configured to support and to mount the pump unit, the mounting device comprising a support part having a ring-shape, the support part being configured to radially enclose, to support, and to provide a vibration-decoupling of the pump unit, the support part comprising, an axial support part stop surface which is configured to correspond to and to cooperate with the axial pump unit stop surface so as to axially stop the pump unit in an axial mounting direction, a mounting part which is configured to attach the mounting device to a corresponding motor vehicle mounting structure, and a tensioned friction enhancing longitudinal lip ring which is arranged to gaplessly surround the pump unit utricularly so as to frictionally lock the pump unit in an axial dismounting direction, wherein, the tensioned friction enhancing longitudinal lip ring is conical prior to an assembly of the pump unit with the mounting device.

11. The automotive fluid pump arrangement as recited in claim 10, wherein the tensioned friction enhancing longitudinal lip ring is provided as an integral part of the support part.

12. The automotive fluid pump arrangement as recited in claim 10, wherein, the tensioned friction enhancing longitudinal lip ring comprises a connection zone, and the tensioned friction enhancing longitudinal lip ring, as seen from the connection zone with the support part, extends axially in the axial mounting direction of the pump unit.

13. The automotive fluid pump arrangement as recited in claim 10, wherein, the pump unit further comprises an axial front-end surface and an electrical plug socket, and the electrical plug socket is arranged to extend axially from the axial front-end surface of the pump unit.

14. The automotive fluid pump arrangement as recited in claim 10, wherein the mounting part is an integral part of the support part.

15. The automotive fluid pump arrangement as recited in claim 10, wherein, the tensioned friction enhancing longitudinal lip ring has an inside perimeter, the pump unit further comprises a pump unit mounting section which has an outside perimeter, and prior to an assembly of the pump unit with the mounting device, the inside perimeter of the tensioned friction enhancing longitudinal lip ring is at least 5% smaller than the outside perimeter of the pump unit mounting section.

16. The automotive fluid pump arrangement as recited in claim 15, wherein the support part and the pump unit mounting section of the pump unit corresponding thereto are both circular.

17. The automotive fluid pump arrangement as recited in claim 16, wherein, the pump unit further comprises a tangential pump outlet, and the axial support part stop surface and the axial pump unit stop surface are each correspondingly castellated so as to provide a form-fitted connection for an anti-rotation protection of the pump unit.

18. The automotive fluid pump arrangement as recited in claim 16, wherein, the tensioned friction enhancing longitudinal lip ring has a diameter, the pump unit mounting section has a dimeter, and the diameter of the tensioned friction enhancing longitudinal lip ring is at least 5% smaller than the diameter of the pump unit mounting section before the pump unit is assembled with the mounting device.

* * * * *